US006187146B1

(12) United States Patent
Congdon et al.

(10) Patent No.: US 6,187,146 B1
(45) Date of Patent: Feb. 13, 2001

(54) MOUNTING ARRANGEMENT FOR WET END WEIGHT MEASUREMENT SYSTEM

(75) Inventors: Thomas W. Congdon; Mark A. Taylor, both of North Vancouver (CA)

(73) Assignee: Honeywell Measurex Devron Inc., North Vancouver (CA)

( * ) Notice: Under 35 U.S.C. 154(b), the term of this patent shall be extended for 0 days.

(21) Appl. No.: 09/374,811

(22) Filed: Aug. 16, 1999

(51) Int. Cl.[7] ..... D21F 7/04

(52) U.S. Cl. ..... 162/255; 162/255; 162/262; 162/263; 162/DIG. 10; 162/DIG. 11; 162/199; 248/901; 248/904; 277/300; 429/100

(58) Field of Search ..... 162/255, 262, 162/263, DIG. 10, DIG. 11, 199, 281; 248/901, 904; 429/100; 277/300

(56) References Cited

U.S. PATENT DOCUMENTS 5,975,532 * 11/1999 Karttunen ..... 277/300

OTHER PUBLICATIONS

Vyse, Robert et al; "Rapid MD and CD Weight Control Utilizing a New Wet End Weight Measurement System,"; Paper presented at the 84th Canadian Pulp and Paper Association Annual Meeting in Montreal Canada Jan. 1998.

* cited by examiner

*Primary Examiner*—Stanley S. Silverman
*Assistant Examiner*—Mark Halpern
(74) *Attorney, Agent, or Firm*—Christie, Parker & Hale, LLP

(57) ABSTRACT

A mounting system for removably mounting a sensor array adjacent the wire of a papermaking machine. The mounting system comprises an elongate base member formed with a tongue or groove with a corresponding interlocking groove or tongue formed on the sensor array adapted to be slidably received and retained by the elongate base member. The tongue and groove are dimensioned to permit relative movement of the sensor array with respect to the base member. An inflatable bladder is housed between the elongate base member and the sensor array and the bladder is adapted to be inflated to move the tongue and groove into a locked position to fix the position of the sensor array with respect to the elongate base member. This arrangement allows for easy and efficient removal of the sensor array when the bladder is unpressurized while providing reliable clamping when the bladder is inflated. Adjustable fasteners associated with the base are also provided to allow for fine tuning of the height of the sensor array and the tilt of the array to accommodate the wire of the papermaking machine.

18 Claims, 2 Drawing Sheets

MOUNTING ARRANGEMENT FOR WET END WEIGHT MEASUREMENT SYSTEM

FIELD OF THE INVENTION

This invention relates to a mounting and clamping arrangement for positioning sensors at the wet end of papermaking machinery.

BACKGROUND OF THE INVENTION

In papermaking machinery, determination of machine direction (MD) and cross-machine (CD) weight profiles is generally performed by scanning sensors that operate at the dry end of the paper machine. As a result, MD and CD weight control response time has been limited by the time necessary to obtain weight and moisture profiles from the scanning system. The time delay in getting the paper web to the scanning system is the total transit time through the paper machine plus the time required to thread the sheet from the wire into and through the press section, then the dryer, and finally through the calender. The accumulation of all these times often exceeds 30 minutes. It also takes an additional five minutes or so to acquire enough scans to give a reliable estimate of the MD/CD profiles. This accumulated time represents lost production time as paper manufactured during this period is discarded to the broke pit.

To address the above shortcoming of existing papermaking machinery, novel sensors have been developed to obtain rapid measurement of the MD/CD weight profile of the paper web as soon as possible after the start of the paper making process. The novel sensors are the subject of co-pending U.S. patent applications Ser. No. 08/766,864 and Ser. No. 08/789,086.

The faster the CD profile is measured and stabilized at start up, the easier the sheet threading procedure will be and the faster the time to saleable paper product with minimum loss to the broke pit. The novel sensors are positioned at the wet end of the papermaking machine at or near the dry line under the wire portion of a single wire of the machine. Alternatively, the sensors can be positioned adjacent a side of one wire of the two wires on a twin wire machine. The sensors operate by measuring the water and fiber weight on the wire portion. Each sensor comprises an array of sensor elements that measure the weight of the water on the wire by measuring the effective electrical properties of the water between individual sensor elements. The effective electrical properties are related to the water weight over each sensor element. The water weight in turn is correlated to the fiber weight. The sensor array is built into a foil-like structure that extends below the wire in the cross-machine direction. The sensor array is therefore able to simultaneously monitor the full CD width of the papermaking machine. Typically, up to 512 CD data boxes can be provided giving a 25 mm CD resolution. Full profile data can be measured at up to 600 times per second and this is used to calculate MD updates 10 times per second and CD control profiles every second.

It is important that the sensor elements reliably contact the underside of the forming wire to ensure that accurate measurements are taken. This has been a weakness of prior designs. It is necessary that the sensor arrays be removable to permit maintenance and replacement. Prior art mounting systems rely on a T-rail and T-slot arrangement to removably mount the sensor array to a base mounting beam. Relatively large clearances are required for installation and removal of such an arrangement which prevents a consistent mounting and alignment of the sensor array with respect to the wire with the result that data obtained from the sensors is not always reliable. Furthermore, the T rail/T slot arrangement limits the vertical position of the sensor array to the location of the T rail without the possibility of adjusting the sensors to ensure proper contact with the wire.

SUMMARY OF THE INVENTION

To address the foregoing problems, applicant has developed a new sensor array mounting scheme that relies on a loose fitting tongue and groove arrangement with an inflatable air bladder to lock the sensor array in position to ensure proper contact with the wire.

Accordingly, the present invention provides a mounting system for removably mounting a sensor array adjacent the wire portion of a papermaking machine comprising:

- an elongate base member formed with one of a tongue and a groove;
- a corresponding interlockable tongue or groove formed on the sensor array adapted to be slidably received and retained by the elongate base member, the tongue and groove being dimensioned to permit relative movement of the sensor array with respect to the base member; and
- an inflatable bladder housed between the elongate base member and the sensor array adapted to be inflated to move the tongue and groove into a locked position to fix the position of the sensor array with respect to the elongate base member.

In a further aspect, the present invention provides in a papermaking machine having a wire portion and a removable sensor array mounted adjacent the wire portion by an elongate base member formed with one of a tongue and a groove, and a corresponding interlocking groove or tongue formed on the sensor array adapted to be slidably received and retained by the elongate base member, the improvement comprising:

- the tongue and groove being dimensioned to permit relative movement of the sensor array with respect to the base member; and
- an inflatable bladder housed between the elongate base member and the sensor array adapted to be inflated to move the tongue and groove into a locked position to fix the position of the sensor array with respect to the elongate base member.

The mounting system and apparatus of the present invention provide an arrangement that allows for easy and efficient removal of the sensor array when the bladder is unpressurized while providing reliable clamping when the bladder is inflated to hold the sensor array securely in position to ensure proper contact with the wire. In addition, the use of adjustable turnbuckles to support the base member allows for further refinement of the position of the mounted sensor array with respect to the wire.

BRIEF DESCRIPTION OF THE DRAWINGS

Aspects of the present invention are illustrated, merely by way of example, in the accompanying drawings in which.

DESCRIPTION OF THE PREFERRED EMBODIMENTS

Figure 1:
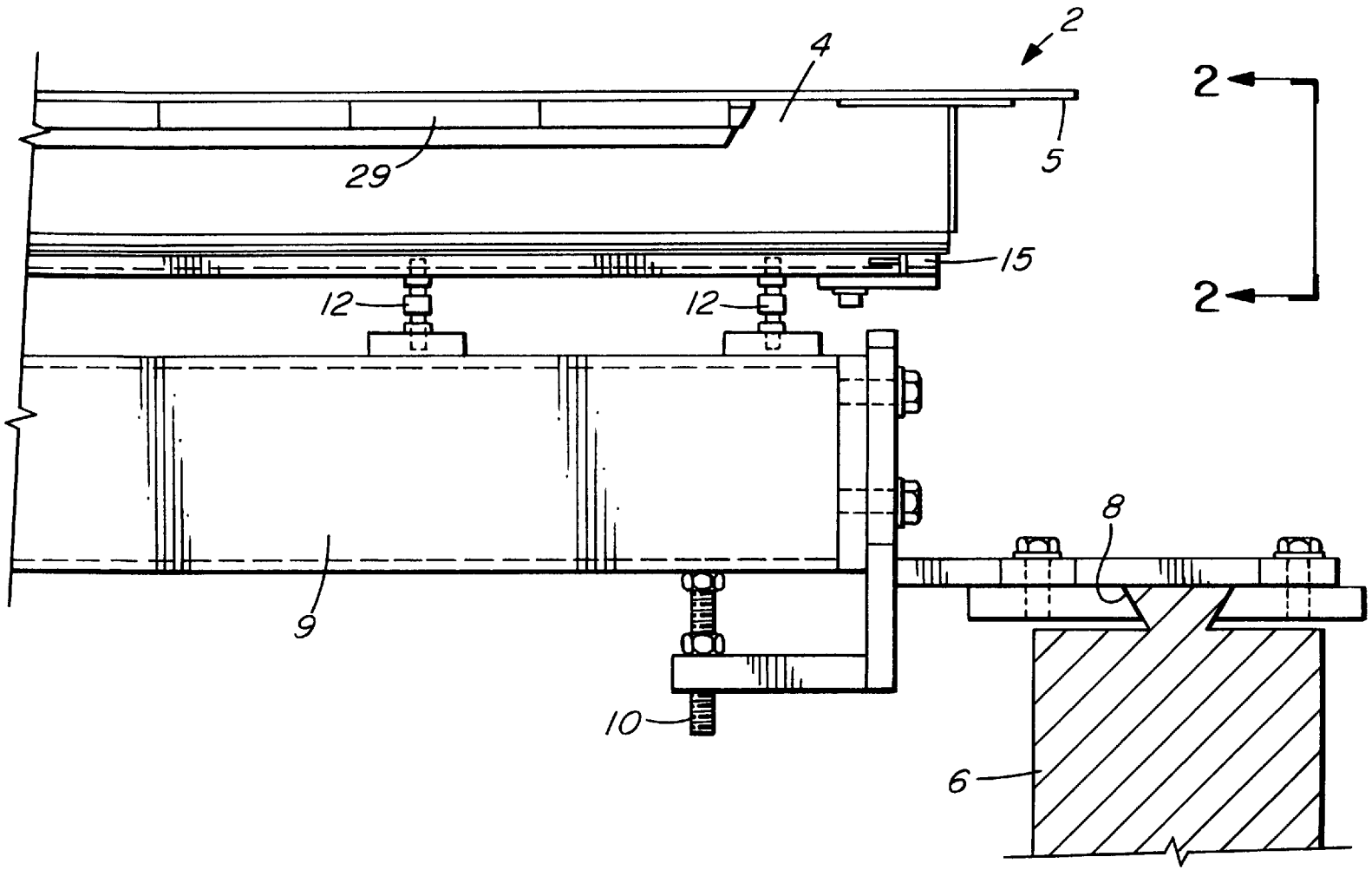
FIG. 1 is a side elevation view of the mounting system of the present invention.

Referring to FIG. 1, there is shown a preferred embodiment of a mounting system 2 according to the present invention for removably positioning a sensor array 4 below the wire 5 at the wet end of a papermaking machine. In the illustrated embodiment, the sensor array is a conventional foil array. It will be appreciated by those skilled in the art that other sensor arrays can be used with the mounting system of the present invention.

As is conventional, papermaking equipment includes a foundation rail 6 to which is clamped at 8 a mounting beam 9 that extends across the width of the papermaking machine in the cross-direction (CD). A global jacking screw 10 is provided at each end of the mounting beam 9 to provide coarse adjustment of the mounting beam below the wire 5.

Figure 2:
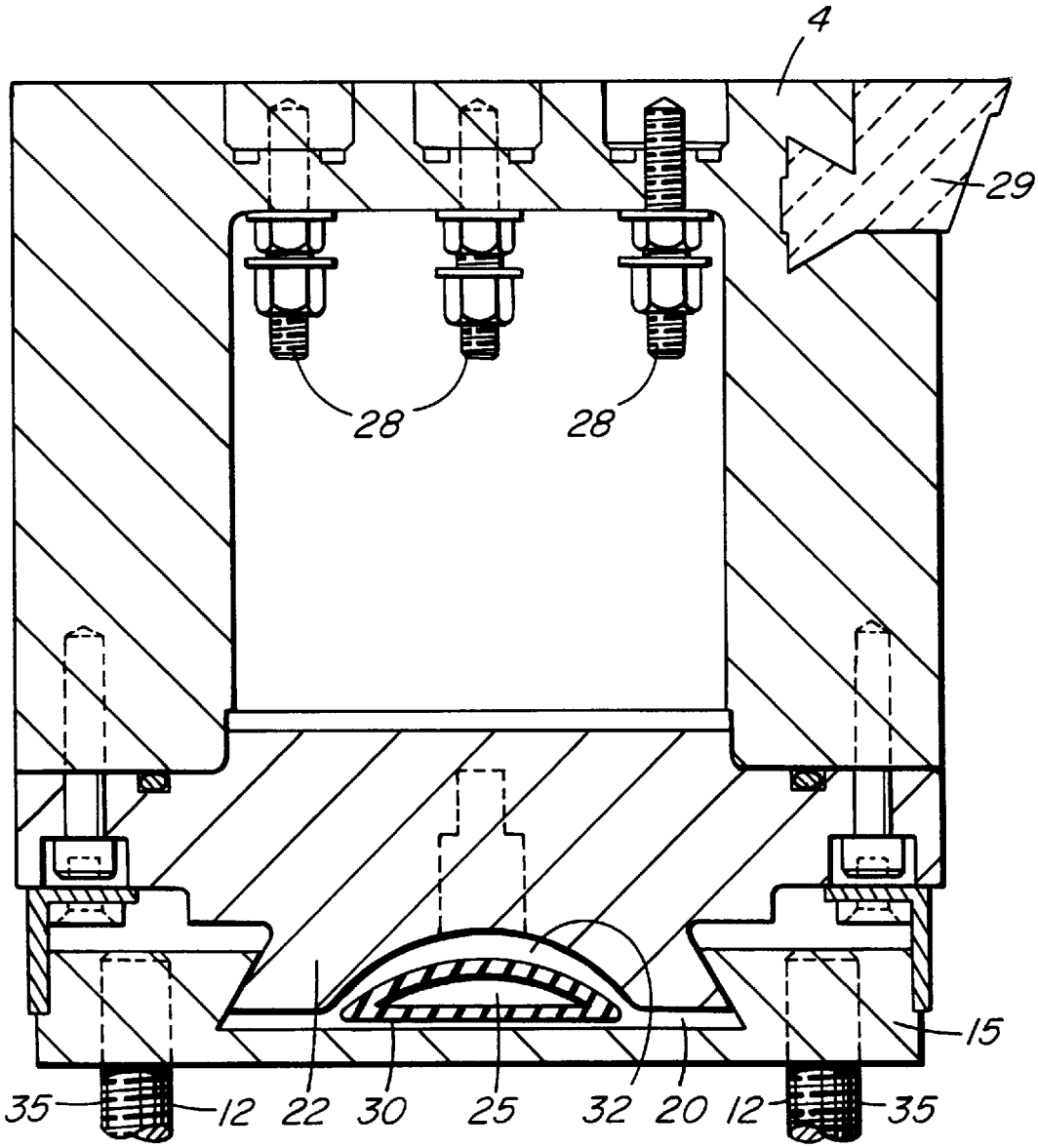
FIG. 2 is a detail section view taken along line 2—2 of FIG. 1 through the sensor array showing the tongue and groove arrangement.

In the mounting system of the present invention, mounting beam 9 supports, via a plurality of adjustable fasteners 12, an elongate base member 15 that extends across the papermaking machine in the cross-direction. As best shown in FIG. 2, base member 15 is formed with a dovetail groove 20 adapted to slidably receive in the cross-machine direction a correspondingly shaped dovetail tongue 22 formed on the lower edge of the sensor array 4. Groove 20 and tongue 22 are dimensioned so that the resulting interlocking tongue and groove joint between base member 15 and sensor array 4 permits relative movement of the sensor array with respect to the base member in the vertical direction. This free play allows for easy insertion of the sensor array into position beneath the wire. It will be appreciated that the tongue and groove arrangement specifically illustrated in FIG. 2 can be reversed without changing the general operating principle of the mounting system of the present invention. For example, sensor array 4 can be formed with a groove and base member 15 with a tongue.

Sensor array 4 comprises a plurality of sensors 28 housed in a generally rectangular box with a leading ceramic edge 29.

An inflatable bladder 25 is provided between elongate base member 15 and sensor array 4. When bladder 25 is inflated, tongue 22, and hence sensor array 4, are moved upwardly until the sloped walls of tongue 22 and groove 20 engage and interlock to fix the sensor array 4 into a stable position with respect to the elongate base member.

Preferably, as illustrated in FIG. 2, bladder 25 is housed in groove 20 formed in base member 15. Inflatable bladder 25 is preferably generally dome shaped in cross-section and formed with a substantially flat base 30 that extends substantially the length of the base member in the cross-machine direction. Flat base 30 engages against base member 15 while tongue 22 is formed with a concave cavity 32 dimensioned to accommodate the domed surface of the bladder.

To further refine the adjustability of the mounting system of the present invention, base member 15 is provided with adjustable fasteners 12 in the form of turnbuckle assemblies 35 that extend between the base member and mounting beam 9. Preferably, turnbuckle assemblies 35 are arranged in pairs at intervals along the length of base member 15. Each pair is positioned on opposite sides of the longitudinal axis of the base member as best shown in FIG. 2. By adjusting the length of the turnbuckle assemblies, the sensor array already locked into position with respect to base member 15 by inflatable bladder 25 can be aligned with the existing drainage table of the wire to ensure reliable contact with the wire. The turnbuckles allow for adjustment of the position of the sensor array in both the machine direction and the cross-machine direction. In particular, the turnbuckles can be adjusted to fine tune the position of the sensor array by adjusting the height and tilt angle of the sensor array. Height adjustment is useful to control the contact pressure of the sensor array with the wire. Adjustment of the tilt angle accommodates variations in the wire.

Although the present invention has been described in some detail by way of example for purposes of clarity and understanding, it will be apparent that certain changes and modifications may be practised within the scope of the appended claims.

We claim:

1. A mounting system for removably mounting a sensor array adjacent the wire portion of a papermaking machine comprising:

an elongate base member formed with one of a tongue and a groove extending in a first plane;

a corresponding interlockable tongue or groove formed on a sensor array adapted to be slidably received in the first plane by the elongate base member, the tongue and groove being dimensioned to permit relative movement generally normal to the first plane of the sensor array with respect to the base member; and an inflatable bladder housed between the elongate base member and the sensor array adapted to be inflated to move the tongue and groove into a locked position by relative movement generally normal to the first plane of the tongue and groove to fix the position of the sensor array with respect to the elongate base member.

2. A mounting system as claimed in claim 1 in which the tongue and groove have corresponding dove tail cross-sections.

3. A mounting system as claimed in claim 1 in which the elongate base member is mountable to the papermaking machine by adjustable fasteners.

4. A mounting system as claimed in claim 3 in which the adjustable fasteners comprise turnbuckle assemblies.

5. A mounting system as claimed in claim 3 in which the adjustable fasteners are positioned in pairs at intervals along the length of the elongate base member, the members of a pair being on opposite sides of the longitudinal axis of the base member.

6. A mounting system as claimed in claim 1 in which the inflatable bladder is generally dome shaped in cross-section having a substantially flat base.

7. A mounting system as claimed in claim 6 in which the inflatable bladder extends substantially the length of the base member.

8. A mounting system as claimed in claim 6 in which the flat base of the inflatable bladder engages one of the base member and the sensory array and the other of the base member and the sensory array includes a cavity dimensioned to accommodate the dome portion of the bladder.

9. A mounting system as claimed in claim 8 in which the bladder is positioned within the groove and the cavity is formed in the tongue.

10. In a papermaking machine having a wire portion and a removable sensor array mounted adjacent the wire portion by an elongate base member formed with one of a tongue and a groove, and a corresponding interlocking groove or tongue formed on the sensor array adapted to be slidably received in a first plane by the elongate base member, the improvement comprising:

the tongue and groove being dimensioned to permit relative movement generally normal to the first plane of the sensor array with respect to the base member; and an inflatable bladder housed between the elongate base member and the sensor array adapted to be inflated to move the tongue and groove into a locked position by relative movement generally normal to the first plane of the tongue and groove to fix the position of the sensor array with respect to the elongate base member.

11. Apparatus as claimed in claim 10 in which the tongue and groove have corresponding dove tail cross-sections.

12. Apparatus as claimed in claim 10 in which the elongate base member is mounted to the papermaking machine by adjustable fasteners.

13. Apparatus as claimed in claim 12 in which the adjustable fasteners comprise turnbuckle assemblies.

14. Apparatus as claimed in claim 12 in which the adjustable fasteners are positioned in transversely oriented pairs at intervals along the length of the elongate base member.

15. Apparatus as claimed in claim 10 in which the inflatable bladder is generally dome shaped in cross-section having a substantially flat base.

16. Apparatus as claimed in claim 10 in which the inflatable bladder extends substantially the length of the base member.

17. Apparatus as claimed in claim 15 in which the flat base of the inflatable bladder engages one of the base member and the sensory array and the other of the base member and the sensory array includes a cavity dimensioned to accommodate the dome portion of the bladder.

18. A mounting system as claimed in claim 17 in which the bladder is positioned within the groove and the cavity is formed in the tongue.

* * * * *